US012655975B2

(12) United States Patent
Feie et al.

(10) Patent No.: US 12,655,975 B2
(45) Date of Patent: Jun. 16, 2026

(54) COMBUSTION LINER FOR GAS TURBINE ENGINE

(71) Applicant: General Electric Company, Schenectady, NY (US)

(72) Inventors: Brian Gregg Feie, Cincinnati, OH (US); Thomas Christopher Farrell, Asheville, NC (US); Andrew Merz, Cincinnati, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/650,224

(22) Filed: Apr. 30, 2024

(65) Prior Publication Data

US 2025/0334268 A1 Oct. 30, 2025

(51) Int. Cl.
*F23R 3/00* (2006.01)

(52) U.S. Cl.
CPC ..... *F23R 3/002* (2013.01); *F23R 3/007* (2013.01); *F23R 2900/00018* (2013.01)

(58) Field of Classification Search
None
See application file for complete search history.

(56) References Cited

U.S. PATENT DOCUMENTS 3,250,070 A 5/1966 Milewski et al.
4,555,901 A 12/1985 Wakeman et al.
5,329,773 A * 7/1994 Myers ..... F23R 3/08 60/757
5,353,587 A 10/1994 Halila
5,431,532 A * 7/1995 Humke ..... F01D 21/045 415/9
6,526,756 B2 3/2003 Johnson et al.
6,553,767 B2 4/2003 Farmer et al.
6,675,582 B2 * 1/2004 Monty ..... F23R 3/08 60/757
7,647,779 B2 1/2010 Shi et al.
8,245,513 B2 8/2012 Huth et al.
8,544,277 B2 10/2013 Johnson et al.
10,385,870 B2 8/2019 Crall
10,399,284 B2 9/2019 Pause et al.
2013/0074501 A1 3/2013 Tiwary et al.
2013/0216389 A1 * 8/2013 Jamison ..... F01D 5/3007 416/239
2014/0338347 A1 11/2014 Gage et al.
2015/0075172 A1 3/2015 Stuttaford et al.
(Continued)

*Primary Examiner* — Edwin Kang
(74) *Attorney, Agent, or Firm* — Dority & Manning, P.A.

(57) ABSTRACT

A liner for a combustion section of a gas turbine engine includes a base portion and a stiffening portion. The base portion includes a plurality of plies of a composite material including a first ply having a fiber direction aligned with a circumferential direction of the liner and a second ply adjacent to the first ply, the second ply having a fiber direction angled away from the circumferential direction. The stiffening portion is disposed on the base portion and includes a plurality of plies of the composite material including a first ply having a fiber direction aligned with the circumferential direction, a second ply adjacent to the first ply the second ply having a fiber direction aligned with the circumferential direction, and a third ply adjacent to the second ply, the third ply having a fiber direction angled away from the circumferential direction.

19 Claims, 7 Drawing Sheets

(56) References Cited

U.S. PATENT DOCUMENTS

| | | | | |
|---|---|---|---|---|
| 2016/0003103 | A1* | 1/2016 | Shapiro | F01D 25/005 416/185 |
| 2016/0222800 | A1* | 8/2016 | Kleinow | F01D 5/3084 |
| 2017/0348876 | A1* | 12/2017 | Lin | B32B 27/283 |
| 2018/0017258 | A1* | 1/2018 | Stieg | F23R 3/007 |
| 2018/0272568 | A1* | 9/2018 | Parolini | B29C 35/02 |
| 2018/0290334 | A1* | 10/2018 | Corsmeier | F01D 25/005 |
| 2018/0370158 | A1* | 12/2018 | Gallier | B29C 70/545 |
| 2020/0095880 | A1 | 3/2020 | Clark et al. | |
| 2020/0148491 | A1* | 5/2020 | Lin | B65H 3/0883 |
| 2021/0063016 | A1* | 3/2021 | Stieg | F23R 3/007 |
| 2023/0021947 | A1* | 1/2023 | Konopaske | C04B 41/4572 |
| 2024/0116828 | A1* | 4/2024 | Jarmon | C04B 41/4511 |

* cited by examiner

COMBUSTION LINER FOR GAS TURBINE ENGINE

FIELD

The present disclosure relates to a liner for a combustion section of a gas turbine engine.

BACKGROUND

Gas turbine engines are driven by a flow of combustion gases passing through a turbine section of the turbine engine to rotate a multitude of turbine blades, which, in turn, rotate a multitude of compressor blades, which supply compressed air to the combustor for combustion. A combustor can be provided within the turbine engine and is fluidly coupled with a turbine into which the combusted gases flow.

In a typical turbine engine, air and fuel are supplied to a combustion chamber, mixed, and then ignited to produce hot gas. The hot gas is then fed to a turbine where it rotates a turbine to generate power.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
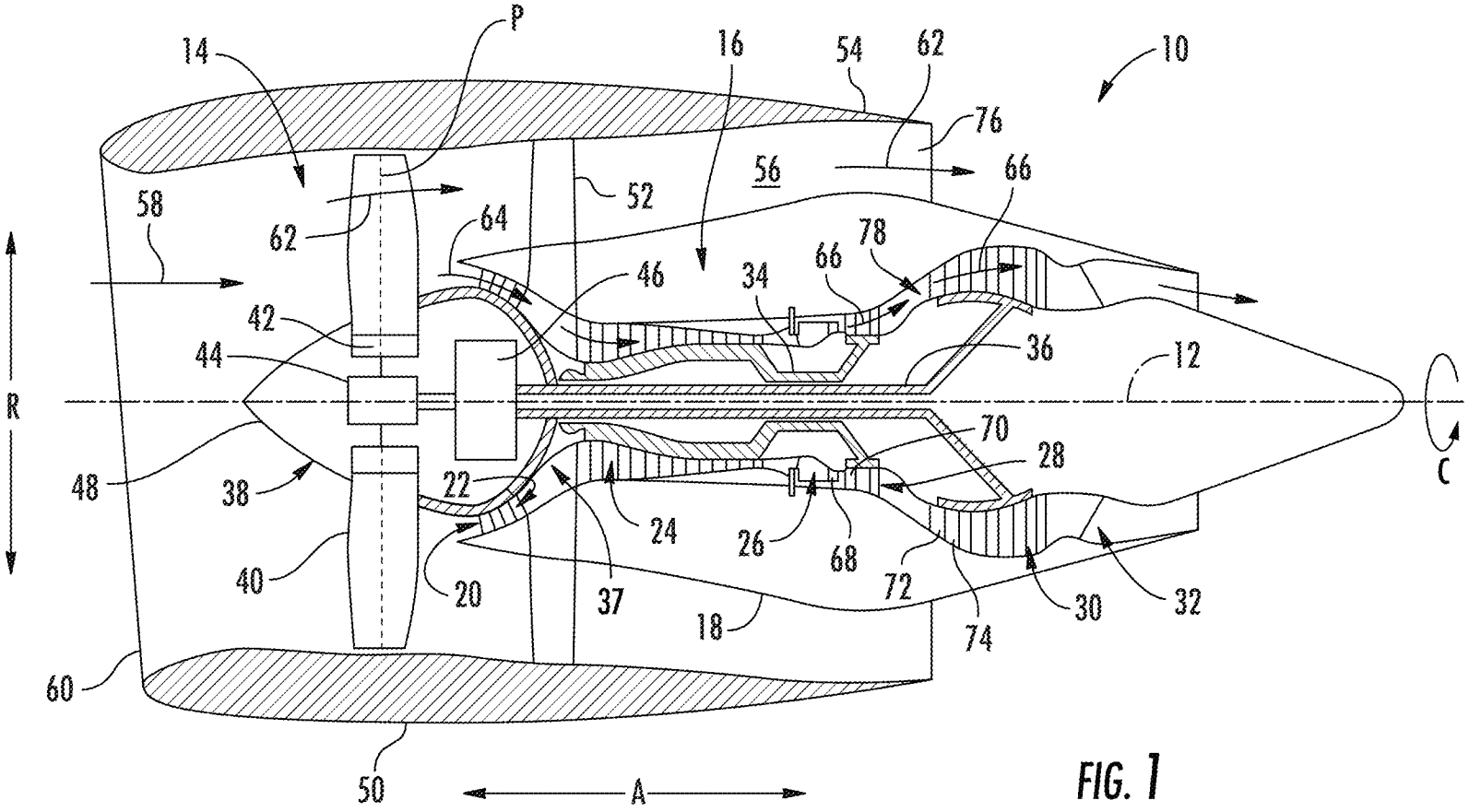
FIG. 1 is a schematic view of an exemplary gas turbine engine.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The singular forms "a", "an", and "the" include plural references unless the context clearly dictates otherwise.

The phrases "from X to Y" and "between X and Y" each refers to a range of values inclusive of the endpoints (i.e., refers to a range of values that includes both X and Y).

The terms "forward" and "aft" refer to relative positions within a gas turbine engine, with "forward" referring to a position closer to an engine inlet and "aft" referring to a position closer to an engine nozzle or exhaust.

A "fiber direction" is an angle defined between a fiber of a ply and a reference line, such as a default axis in a two-dimensional coordinate system, within an angle tolerance defined by the apparatus laying the ply. That is, when laying a ply, tolerance stackup in the mechanical components of the apparatus laying the ply results in an angle tolerance that defines the precision to which the apparatus lays the ply to an intended fiber direction. The angle tolerance may be small relative to the intended fiber direction, such as from 0 to 3 degrees. The fiber direction of a first ply is "angled away" from another fiber direction of a second ply when a difference of the angles defining the two fiber directions is greater than the angle tolerance, i.e., placed in a manner outside of the angle tolerance caused by the apparatus laying the plies. The fiber direction of a ply is "aligned" with a specified angle in the two-dimensional coordinate system when a difference between the fiber direction of the laid ply and the specified angle is within the angle tolerance.

The present disclosure is generally related to stress management of a liner in a combustion section of a gas turbine engine. Compressed air and fuel are provided to the combustion section where the air-fuel mixture ignites and forms combustion gases. The combustion gases heat the liner, inducing thermal stresses within the CMC material in a circumferential or "hoop" direction. The thermal stresses may propagate through thermo-mechanical fatigue, inducing mechanical stresses that form and grow cracks in the liner, potentially separating parts of the liner from each other. These circumferential stresses are typically greater than stresses in other directions, such as radial stresses or axial stresses.

Accordingly, when designing and manufacturing liners for combustion sections, additional strength is desired to mitigate the circumferential stresses. One such method for mitigating the circumferential stresses is to align fibers of the CMC material along the circumferential direction. When the fibers are aligned in the circumferential direction, the circumferential stresses are distributed along the lengths of the fibers, which has greater resistance to tension and deformation than other dimensions of the fibers. To increase the number of fibers in the circumferential direction, additional plies of the CMC material are laid such that the fibers of the plies substantially align with the circumferential direction.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine, sometimes also referred to as a "turbofan engine." As shown in FIG. 1, the gas turbine engine 10 defines an axial direction A (extending parallel to a longitudinal centerline 12 provided for reference), a radial direction R, and a circumferential direction C extending about the longitudinal centerline 12. In general, the gas turbine engine 10 includes a fan section 14 and a turbomachine 16 disposed downstream from the fan section 14.

The exemplary turbomachine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32.

A high pressure (HP) shaft 34 (which may additionally or alternatively be a spool) drivingly connects the HP turbine 28 to the HP compressor 24. A low pressure (LP) shaft 36 (which may additionally or alternatively be a spool) drivingly connects the LP turbine 30 to the LP compressor 22. The compressor section, combustion section 26, turbine section, and jet exhaust nozzle section 32 together define a working gas flowpath 37.

For the embodiment depicted, the fan section 14 includes a fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable pitch change mechanism 44 configured to collectively vary the pitch of the fan blades 40, e.g., in unison. The gas turbine engine 10 further includes a power gear box 46, and the fan blades 40, disk 42, and pitch change mechanism 44 are together rotatable about the longitudinal centerline 12 by LP shaft 36 across the power gear box 46. The power gear box 46 includes a plurality of gears for adjusting a rotational speed of the fan 38 relative to a rotational speed of the LP shaft 36, such that the fan 38 may rotate at a more efficient fan speed.

Referring still to the exemplary embodiment of FIG. 1, the disk 42 is covered by rotatable front hub 48 of the fan section 14 (sometimes also referred to as a "spinner"). The front hub 48 is aerodynamically contoured to promote an airflow through the plurality of fan blades 40.

Additionally, the exemplary fan section 14 includes an annular fan casing or outer nacelle 50 that circumferentially surrounds the fan 38 and/or at least a portion of the turbomachine 16. It should be appreciated that the nacelle 50 is supported relative to the turbomachine 16 by a plurality of circumferentially-spaced outlet guide vanes 52 in the embodiment depicted. Moreover, a downstream section 54 of the nacelle 50 extends over an outer portion of the turbomachine 16 so as to define a bypass airflow passage 56 therebetween.

During operation of the gas turbine engine 10, a volume of air 58 enters the gas turbine engine 10 through an associated inlet 60 of the nacelle 50 and fan section 14. As the volume of air 58 passes across the fan blades 40, a first portion 62 of air is directed or routed into the bypass airflow passage 56 and a second portion 64 of air as indicated by an arrow is directed or routed into the working gas flowpath 37, or more specifically into the LP compressor 22. The ratio between the first portion 62 of air and the second portion 64 of air is commonly known as a bypass ratio. A pressure of the second portion 64 of air is then increased as it is routed through the HP compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft 34, thus causing the HP shaft 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft 36, thus causing the LP shaft 36 to rotate, thereby supporting operation of the LP compressor 22 and/or rotation of the fan 38.

The combustion gases 66 are subsequently routed through the jet exhaust nozzle section 32 of the turbomachine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the gas turbine engine 10, also providing propulsive thrust. The HP turbine 28, the LP turbine 30, and the jet exhaust nozzle section 32 at least partially define a hot gas path 78 for routing the combustion gases 66 through the turbomachine 16.

It should be appreciated, however, that the exemplary gas turbine engine 10 depicted in FIG. 1 is by way of example only, and that in other exemplary embodiments, the gas turbine engine 10 may have any other suitable configuration. For example, although the gas turbine engine 10 depicted is configured as a ducted gas turbine engine (i.e., including the outer nacelle 50), in other embodiments, the gas turbine engine 10 may be an unducted gas turbine engine (such that the fan 38 is an unducted fan, and the outlet guide vanes 52 are cantilevered from the outer casing 18).

Additionally, or alternatively, although the gas turbine engine 10 depicted is configured as a geared gas turbine engine (i.e., including the power gear box 46) and a variable pitch gas turbine engine (i.e., including a fan 38 configured as a variable pitch fan), in other embodiments, the gas turbine engine 10 may additionally or alternatively be configured as a direct drive gas turbine engine (such that the LP shaft 36 rotates at the same speed as the fan 38), as a fixed pitch gas turbine engine (such that the fan 38 includes fan blades 40 that are not rotatable about a pitch axis P), or both. It should also be appreciated, that in still other exemplary embodiments, aspects of the present disclosure may be incorporated into any other suitable gas turbine engine. For example, in other exemplary embodiments, aspects of the present disclosure may (as appropriate) be incorporated into, e.g., a turboprop gas turbine engine, a turboshaft gas turbine engine, or a turbojet gas turbine engine.

Figure 2:
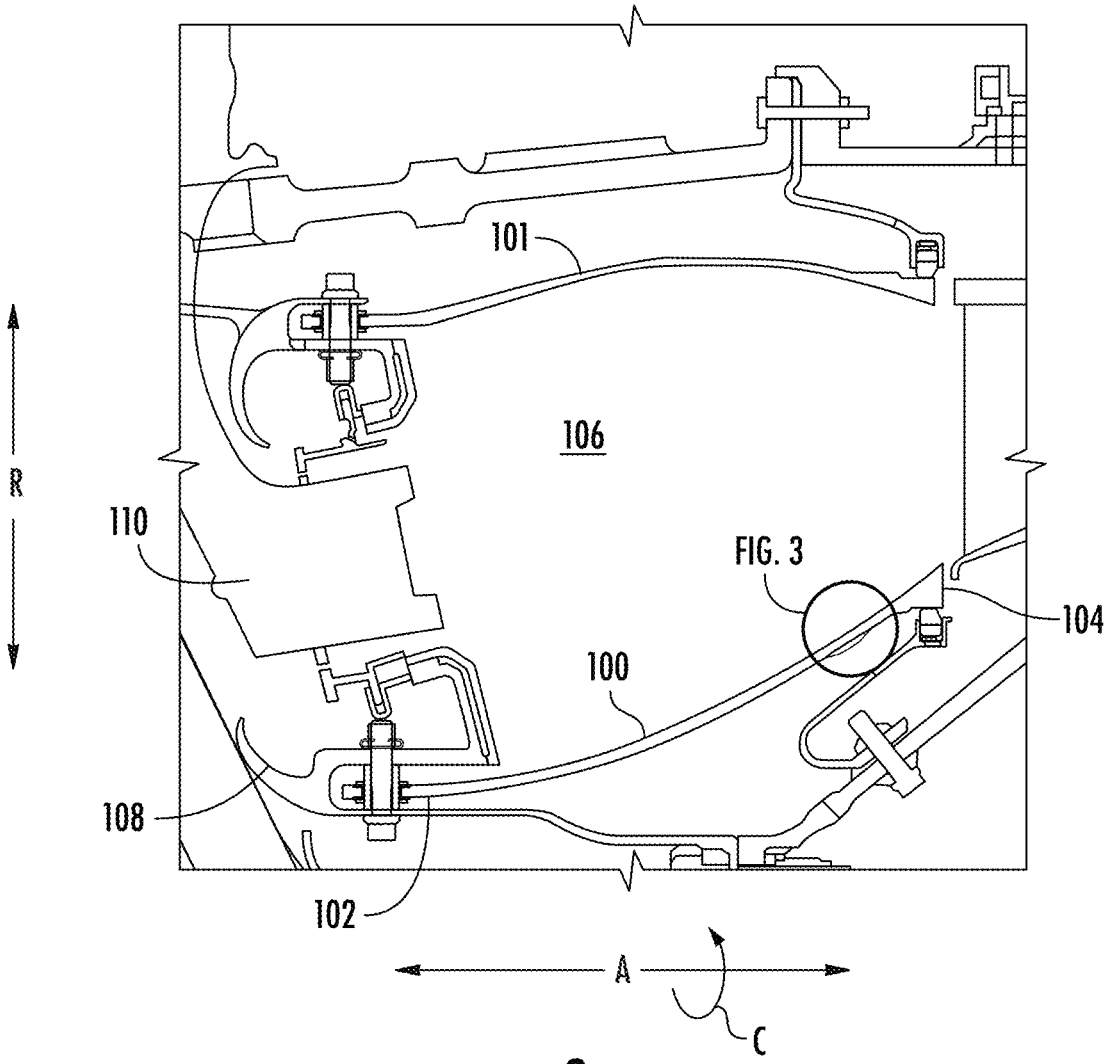
FIG. 2 is a schematic, cross-sectional view of an exemplary combustion liner of the gas turbine engine of FIG. 1.

Now referring to FIG. 2, a schematic, cross-sectional view of a combustion section 26 in accordance with an exemplary embodiment of the present disclosure is provided. The combustion section 26 may be incorporated into an engine 10 configured in a similar manner as the exemplary gas turbine engine 10 of FIG. 1. As will be discussed in more detail, below, the combustion section generally includes a liner 100.

For the embodiment depicted, the liner 100 is formed of a ceramic matrix composite (CMC) material. As used herein, ceramic matrix composite or "CMCs" refers to composites comprising a ceramic matrix reinforced by ceramic fibers. Some examples of CMCs acceptable for use herein can include, but are not limited to, materials having a matrix and reinforcing fibers comprising oxides, carbides, nitrides, oxycarbides, oxynitrides and mixtures thereof. Examples of CMCs with non-oxide materials include, but are not limited to, CMCs with a silicon carbide matrix and silicon carbide fiber (when made by silicon melt infiltration, this matrix will contain residual free silicon); silicon carbide/silicon matrix mixture and silicon carbide fiber; silicon nitride matrix and silicon carbide fiber; and silicon carbide/silicon nitride matrix mixture and silicon carbide fiber. Furthermore, CMCs can have a matrix and reinforcing fibers comprised of oxide ceramics. Specifically, the oxide-oxide CMCs may be comprised of a matrix and reinforcing fibers comprising oxide-based materials such as aluminum oxide ($Al_2O_3$), (silicon dioxide (SiO2), aluminosilicates, and mixtures thereof. Accordingly, as used herein, the term "ceramic matrix composite" includes, but is not limited to, carbon-fiber-reinforced carbon (C/C), carbon-fiber-reinforced silicon carbide (C/SiC), and silicon-carbide-fiber-reinforced silicon carbide (SiC/SiC). In one embodiment, the ceramic matrix composite material has increased elongation, fracture toughness, thermal shock, and anisotropic properties as compared to a (non-reinforced) monolithic ceramic structure.

The liner 100 defines an axial direction A, a radial direction R, and a circumferential direction C. While the directions A, R, C, are generally defined relative to the liner 100, in the exemplary embodiment of FIG. 2, the directions A, R, align with the axial direction A, the radial direction R, and the circumferential direction C of the gas turbine engine 10 described above.

The liner 100 extends between a forward end 102 and an aft end 104 in the axial direction A. The liner 100 defines a combustion chamber 106 in which a fuel-air mixture combusts. The liner 100 is attached to an annular dome 108 that houses a fuel-air mixer 110. Compressed air from the compressor section of the gas turbine engine 10 flows into or through the fuel-air mixer 110, where the compressed air is mixed with fuel and ignited to create combustion gases in the combustion chamber 106. The annular dome 108 is configured to assist in providing such a flow of compressed air from the compressor section into or through the fuel-air mixer 110.

Notably, for the embodiment shown, the liner 100 is more specifically an inner liner and the combustion section 26 further includes an outer liner 101 spaced from the inner liner along the radial direction R, with the inner liner and outer liner 101 together defining at least in part the combustion chamber 106.

It will be appreciated, however, that in other exemplary embodiments, aspects of the present disclosure may additionally or alternatively be applied to the outer liner 101.

Figure 3:
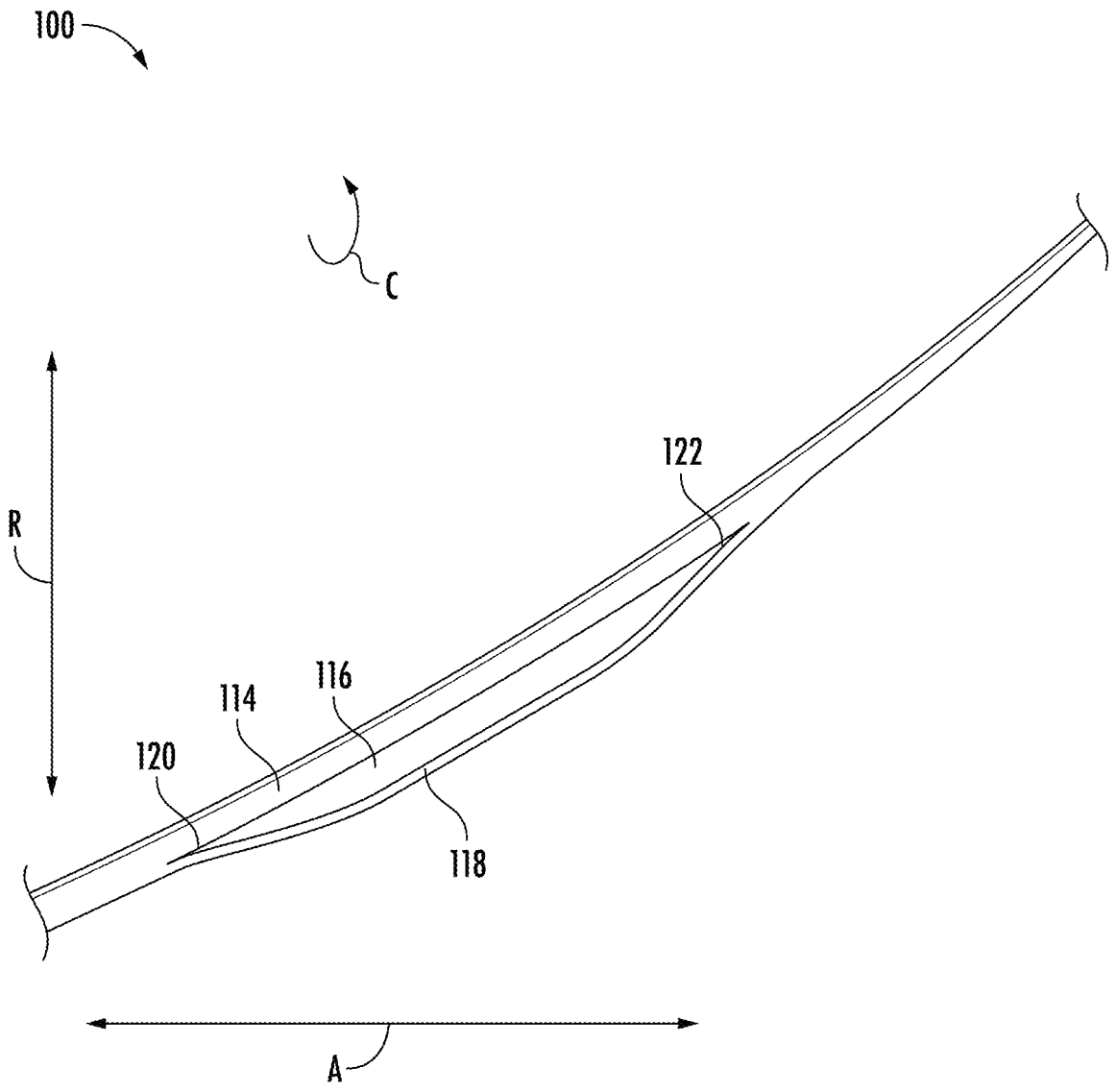
FIG. 3 is a schematic, cross-sectional view of a section of the combustion liner identified with a circle in FIG. 2.

Now referring to FIG. 3, a cross-sectional magnified view of the liner 100 is provided. Specifically, a section of the liner 100 identified in FIG. 2 is shown that has increased strength in the circumferential direction C to mitigate stresses caused by combustion gases in the combustion chamber 106.

The liner 100 includes a base portion 114, a stiffening portion 116, and a covering portion 118. The stiffening portion 116 is disposed between the base portion 114 and the covering portion 118. Each of the base portion 114, the stiffening portion 116, and the covering portion 118 are formed from plies of a CMC material. The CMC materials of each of the base portion 114, the stiffening portion 116, or the covering portion 118 may be a same CMC material. Alternatively, the CMC materials of each of the base portion 114, the stiffening portion 116, or the covering portion 118 may be different CMC materials. Yet alternatively, the CMC materials of two of the base portion 114, the stiffening portion 116, or the covering portion 118 may be a same CMC material that is different from the CMC material of the other of the base portion 114, the stiffening portion 116, or the covering portion 118.

As described above, the CMC material includes reinforcing fibers extending along a length of each ply. Each ply is laid such that the fibers are aligned to a specific fiber direction. In this context, the fiber direction of each of the plies is determined relative to an axis aligned with the circumferential direction C. Fibers that align with the circumferential direction absorb stresses in the circumferential direction C, and fibers that are angled away from the circumferential direction C absorb stresses in other directions, such as the axial direction A.

The base portion 114 includes a plurality of plies of the CMC material. As will be discussed in greater detail below, the plies of the base portion 114 include one or more pairs of adjacent plies. Each pair of plies includes a first ply having a fiber direction aligned with the circumferential direction C and a second ply having a fiber direction angled away from the circumferential direction C. As an example, the fiber direction of the second ply of the pair of plies may be perpendicular to the circumferential direction C, aligning with the axial direction A. The alternating fiber directions of the plies of the base portion 114 provide substantially equal stress absorption in the circumferential and axial directions C, A.

The stiffening portion 116 is disposed on the base portion 114 radially outward of the base portion 114 (e.g., on a cold side of the liner 100). The stiffening portion 116 extends from a forward end 120 to an aft end 122 in the axial direction A and extends around the liner 100 in the circumferential direction C. Specifically, the stiffening portion 116 extends 360 degrees about the axial direction A to form a closed, continuous loop. The forward end 120 of the stiffening portion 116 is disposed at an axial position in the liner 100 that receives greater circumferential stresses than other sections of the liner 100, such as from 50% to 90% of a length of the liner 100 from a forward end of the liner 100 in the axial direction A. In such a manner, the stiffening portion 116 may define a length along the axial direction from the forward end 120 to the aft end 122 greater than or equal to 5% of the length of the liner 100 along the axial direction A and less than or equal to 45% of the length of the liner 100 along the axial direction A, such as between 8% and 35% of the length of the liner 100 along the axial direction A.

The stiffening portion 116 increases a thickness of the liner 100 between the forward end 120 and the aft end 122. In particular, at the forward end 120, the liner 100 smoothly transitions from a first thickness to a second thickness along the stiffening portion 116, the second thickness being greater than the first thickness. Upon reaching the aft end 122, the liner 100 smoothly transitions from the second thickness back to the first thickness. The smooth transition onto and out from the thicker stiffening portion 116 reduces or inhibits crack formation resulting from the difference in the thicknesses, improving mechanical strength of the liner 100.

It will be appreciated, however, that in other exemplary embodiments, the stiffening portion 116 may be disposed at any suitable axial position to absorb the circumferential stresses of the liner 100.

The stiffening portion 116 includes a plurality of plies of the CMC material. As will be described in greater detail below, the plurality of plies includes one or more sets of adjacent plies, each set including a first ply, a second ply, and a third ply. The first ply has a fiber direction aligned with the circumferential direction C, the second ply has a fiber direction aligned with the circumferential direction C, and the third ply has a fiber direction angled away from the circumferential direction C, such as perpendicular to the circumferential direction C. Because the stiffening portion 116 includes more plies having fiber directions aligned with the circumferential direction C than the base portion 114, within the angle tolerance described above, the stiffening portion 116 absorbs more circumferential stresses than the base portion 114. In particular, as described in greater detail below, the stiffening portion 116 may include 33-50% more plies having fiber directions aligned with the circumferential direction C than the base portion 114, depending on the specific numbers of plies in the base portion 114 and the stiffening portion 116.

The covering portion 118 is disposed on the stiffening portion 116 and forms an outermost portion of the liner 100 in the radial direction R. The covering portion 118 includes a plurality of plies of the CMC material having fiber directions similar to those of the base portion 114. In such a form, the base portion 114 and the covering portion 118 absorb stresses in similar manners, and the stiffening portion 116 absorbs more circumferential stresses, thereby increasing absorption of circumferential stresses in the region of the liner 100 where increased circumferential loads may occur.

Figure 4:
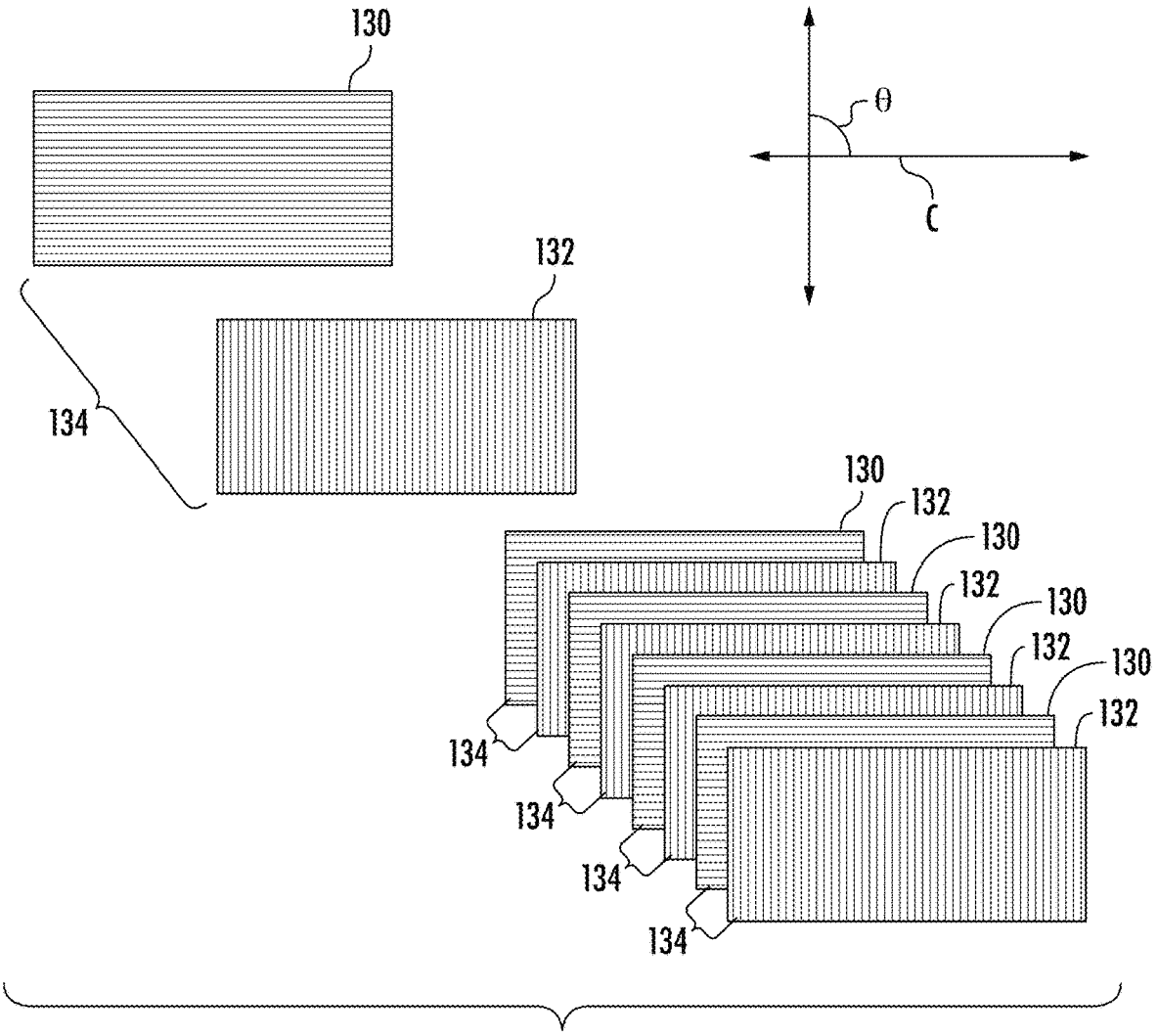
FIG. 4 is a view of exemplary plies for a base portion of the section of the combustion liner of FIG. 3.

As shown in FIG. 4, exemplary plies 130, 132 of the CMC material of the base portion 114 are shown to illustrate a first pattern of fiber directions in which adjacent plies 130, 132 alternate between two different fiber directions. It will be appreciated that the plies 130, 132 of the covering portion 118 may also be arranged in the first pattern shown in FIG. 4. For the purposes of FIG. 4, the plies "130" are plies having a first fiber direction and the plies "132" are plies having a second fiber direction.

In this context, a "pattern" of fiber directions is a sequence of fiber directions in which adjacent plies 130, 132 are arranged. The fiber directions are defined as an angle θ relative to the circumferential direction C, with 0 degrees being aligned with the circumferential direction C (e.g., plies 130) and 90 degrees being perpendicular to the circumferential direction C (e.g., plies 132). It will be appreciated that the numbers provided here are within the angle tolerance of the apparatus laying the plies 130, 132, as described above. For example, if the angle tolerance is 2 degrees, then a ply with a fiber direction from −2 to 2 degrees is "aligned" with the circumferential direction C, and a ply with a fiber direction from 88 to 92 degrees is "perpendicular" to the circumferential direction C. Similarly, if a fiber direction of a ply is described as 30 degrees, this includes fiber directions from 28 to 32 degrees, when the angle tolerance is 2 degrees. The angle tolerance may be determined based on tolerance stackup of the components of the apparatus laying the plies, and the values described may be interpreted to include deviations within the angle tolerance of the specified value.

The first pattern shown in FIG. 4 has a sequence of two fiber directions, the fiber directions being 0 degrees for the first plies 130 and then 90 degrees for the second plies 132. The pattern can be described as a list of angles describing the fiber directions of the plies 130, 132, and the first pattern of FIG. 4 is described for clarity as 0/90 or "a 0/90 pattern." That is, the first pattern is defined for pairs 134 of adjacent plies, with a first ply 130 of the pair 134 of plies having a fiber direction of 0 degrees and a second ply 132 of the pair 134 of plies having a fiber direction of 90 degrees.

In the first pattern, the respective fiber directions of the plurality of plies 130, 132 alternate between the fiber direction aligned with the circumferential direction (0 degrees; plies 130) and the fiber direction perpendicular to the circumferential direction (90 degrees; plies 132). More specifically, FIG. 4 shows five pairs 134 of plies, each pair 134 including a respective first ply 130 having a fiber direction of 0 degrees and a respective second ply 132 having a fiber direction of 90 degrees.

It will be appreciated, however, that the first pattern may include a different sequence of fiber directions, such as 0/60, 0/75, 0/45, or 0/30. That is, the fiber direction of the second ply 132 may be angled away from the fiber direction of the first ply 130 by an angle greater than the angle tolerance up to 90 degrees, such as 30, 45, 60, 75, or other values.

Figure 5A:
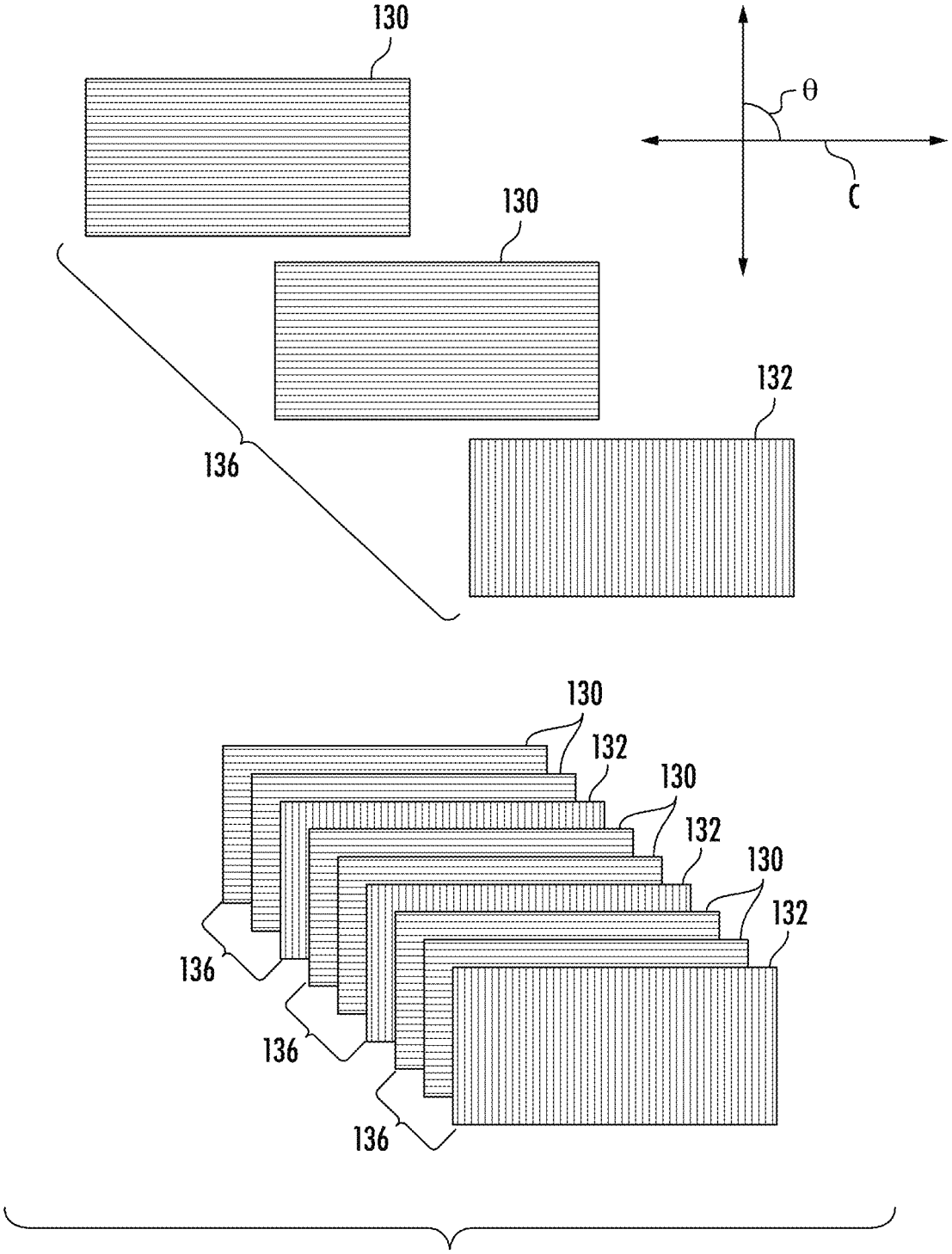
FIGS. 5A-5B are views of exemplary plies for a stiffening portion of the section of the combustion liner of FIG. 3.
Figure 5B:
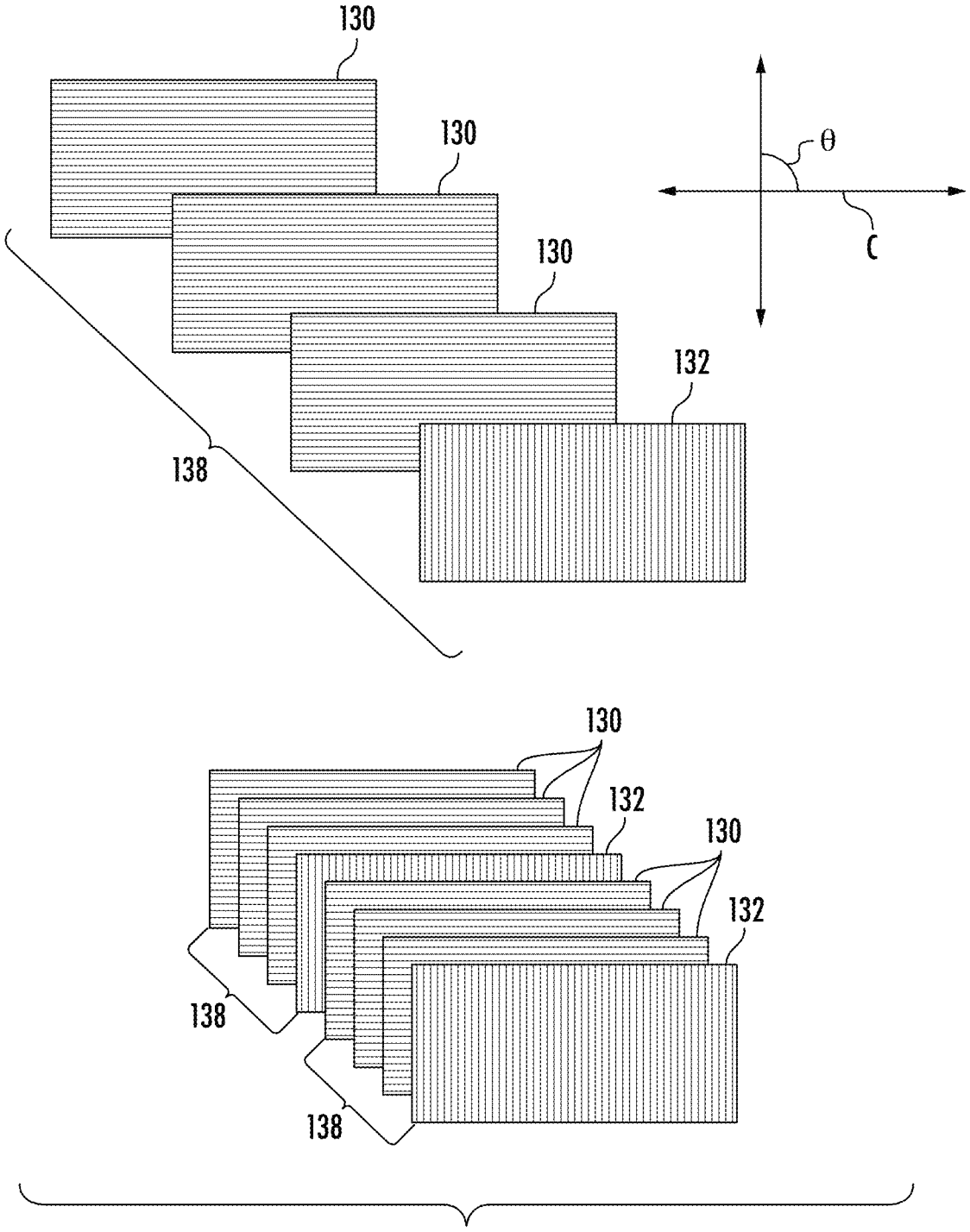

With reference to FIGS. 5A-5B, exemplary plies 130, 132 of the CMC material of the stiffening portion 116 are shown to illustrate additional patterns of fiber directions as may be used for the stiffening portion 116. FIG. 5A shows sets 136 of the plies 130, 132 in a second pattern of 0/0/90, i.e., "a 0/0/90 pattern." FIG. 5B shows sets 138 of the plies 130, 132 a third pattern of 0/0/0/90, i.e., "a 0/0/0/90 pattern." The patterns shown include additional ones of the plies 130 aligned with the circumferential direction (0 degrees; plies 130) to increase absorption of circumferential stresses. Because the fiber directions of FIGS. 5A-5B are the same as the fiber directions of FIG. 4, the numerals 130, 132 in FIGS. 5A-5B will refer to plies having the same fiber directions as the plies 130, 132 in FIG. 4.

The plurality of plies 130, 132 of the stiffening portion 116 in FIGS. 5A and 5B are arranged as a plurality of sets of plies 130, 132 (i.e., set 136 in FIG. 5A and set 138 in FIG. 5B), each one of the plurality of sets 136, 138 of plies 130, 132 adjacent to another of the plurality of sets 136, 138 of plies 130, 132.

As shown in FIG. 5A, each set 136 of plies in plies 130, 132 includes three plies 130, 132. The three plies 130, 132 of the set 136 are arranged in the second pattern, which defines the fiber directions in a sequence of 0 degrees, 0 degrees, and 90 degrees (0/0/90; ply 130, ply 130, ply 132). That is, two of the three plies (the two plies 130) have fiber directions of 0 degrees, and the third of the three plies (the ply 132) has a fiber direction of 90 degrees. More specifically, FIG. 5A shows four sets 136 of plies 130, 132 in the second pattern that may form part of the stiffening portion 116.

In one form, where the base portion 114 and the stiffening portion 116 include a same total number of plies, the base portion 114 has plies 130, 132 arranged in a 0/90 pattern and the stiffening portion 116 has plies 130, 132 arranged in a 0/0/90 pattern, the ratio of the number of plies 130 aligned with the circumferential direction C in the stiffening portion 116 to the number of plies 130 aligned with the circumferential direction C in the base portion 114 is 1.33. That is, if the base portion 114 has 60 plies and the stiffening portion 116 has 60 plies, the stiffening portion 116 has 40 plies 130 and 20 plies 132, and the base portion 114 has 30 plies 130 and 30 plies 132. The ratio of the number of plies 130 in the stiffening portion 116 to the number of plies 130 in the base portion 114 is 40/30, or 1.33 (truncated to two decimal places).

Alternatively, as shown in FIG. 5B, the set 138 of plies 130, 132 may include a fourth ply 130 having a fiber direction aligned with the circumferential direction C. The four plies 130, 132 of the set 138 are arranged in the third pattern, which defines the fiber directions define a sequence of 0 degrees, 0 degrees, 0 degrees, and 90 degrees (0/0/0/90; ply 130, ply 130, ply 130, ply 132). That is, three of the four plies (the plies 130) have fiber directions of 0 degrees and the fourth of the four plies (the ply 132) has a fiber direction of 90 degrees. FIG. 5B shows three sets 138 of plies 130, 132 in the third pattern that may form part of the stiffening portion 116.

In one form, where the base portion 114 and the stiffening portion 116 include a same total number of plies, the base portion 114 has plies 130, 132 arranged in a 0/90 pattern and the stiffening portion 116 has plies 130, 132 arranged in a 0/0/0/90 pattern, the ratio of the number of plies 130 aligned with the circumferential direction C in the stiffening portion 116 to the number of plies 130 aligned with the circumferential direction C in the base portion 114 is 1.50. That is, if the base portion 114 has 60 plies and the stiffening portion 116 has 60 plies, the stiffening portion 116 has 45 plies 130 and 20 plies 132, and the base portion 114 has 30 plies 130 and 30 plies 132. The ratio of the number of plies 130 in the stiffening portion 116 and the number of plies 130 in the base portion 114 is 45/30, or 1.50.

As noted above, including the stiffening portion 116 having additional plies 130 in the circumferential direction C relative to the base portion 114 may provide a local increased circumferential support to the liner 100.

It will be appreciated, however, that in other exemplary embodiments, other suitably patterns may be used for the base portion 114 and stiffening portion 116, whereby the pattern of plies 130, 132 in the stiffening portion 116 includes additional plies 130 in the circumferential direction C to provide local increased circumferential support to the liner 100.

Although the base portion 114 is depicted in FIG. 4 as including four pairs 134, and the stiffening portions 116 of FIGS. 5A and 5B are depicted including four sets 136 and three sets 138, respectively, in other exemplary embodiments, the respective portions may have any other suitable number of sets.

Figure 6:
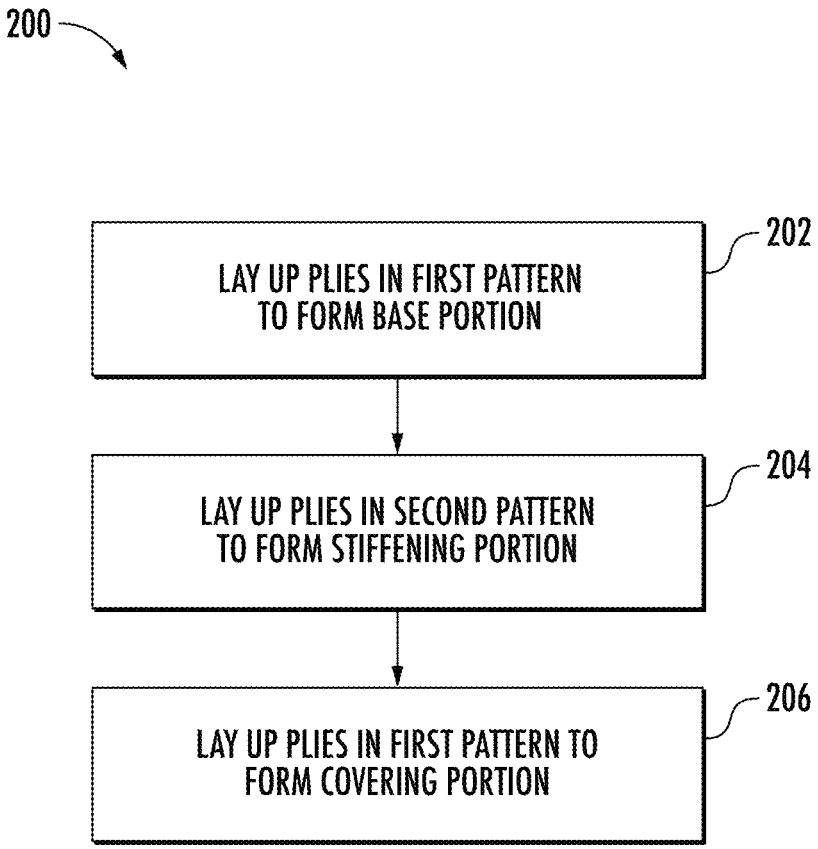
FIG. 6 is a block diagram of an exemplary method for forming the combustion liner of FIG. 3.

Referring now to FIG. 6, a flow diagram of a method 200 of forming a liner in accordance with an exemplary aspect of the present disclosure is provided. The method of FIG. 6 may be utilized to form one or more of the exemplary liners described above with reference to FIGS. 2 through 5B. Accordingly, it will be appreciated that the method 200 may generally be utilized to form the liner for a combustion section of a gas turbine engine. However, in other exemplary aspects, the method 200 may additionally or alternatively be utilized to form any other suitable liner.

As is depicted, the method 200 includes at (202) laying up a plurality of plies of a composite material in a first pattern to form a base portion 114 of the liner. As described above, in the first pattern, the plurality of plies alternate between a fiber direction aligned with the circumferential direction and a fiber direction angled away from the circumferential direction. As an example, the first pattern may be a 0/90 pattern.

The method 200 includes at (204) laying up a plurality of plies of the composite material on the base portion in a second pattern to form a stiffening portion. As described above, the plies of the stiffening portion may include a plurality of sets of plies, and each set of the plurality of sets of plies may include a first ply, a second ply exterior to the first ply, and a third ply exterior to the second ply. In the second pattern, within each set, the first ply may have a fiber direction aligned with the circumferential direction, the second ply may have a fiber direction aligned with the circumferential direction, and the third ply may have a fiber direction angled away from the circumferential direction. In this example, the second pattern is a 0/0/90 pattern.

Alternatively, the plurality of plies of the stiffening portion may have a different pattern, such as a 0/0/0/90 pattern. The plies of the stiffening portion include more plies that are aligned with the circumferential direction than the plies of the base portion to improve absorption of circumferential stresses.

The method 200 includes at (204) laying up a plurality of plies on the stiffening portion in the first pattern to form a covering portion. As described above, the plies of the covering portion may have the same pattern of fiber directions as the plies of the base portion. In such a form, the base portion and the covering portion absorb stresses in substantially the same way, absorbing substantially equal amounts of circumferential stresses and axial stresses. Once the plies of the covering portion are laid, the stack of plies may be processed in a heating or debulking step to form the liner.

Further aspects are provided by the subject matter of the following clauses:

A liner for a combustion section of a gas turbine engine, the liner defining a circumferential direction and an axial direction, the liner including a base portion including a plurality of plies of a composite material and a stiffening portion including a plurality of plies of the composite material, the stiffening portion disposed on the base portion, wherein the plurality of plies of the base portion of the liner include a pair of plies including a first ply having a fiber direction aligned with the circumferential direction and a second ply adjacent to the first ply, the second ply having a fiber direction angled away from the circumferential direction, wherein the plurality of plies of the stiffening portion of the liner include a set of plies including a first ply having a fiber direction aligned with the circumferential direction, a second ply adjacent to the first ply, the second ply having a fiber direction aligned with the circumferential direction, and a third ply adjacent to the second ply, the third ply having a fiber direction angled away from the circumferential direction.

The liner of any of the previous clauses, wherein the plurality of plies of the base portion include a plurality of pairs of plies, each one of the plurality of pairs of plies adjacent to another of the plurality of pairs of plies.

The liner of any of the previous clauses, wherein the plurality of plies of the base portion are arranged such that the respective fiber directions of the plurality of plies of the base portion alternate between the fiber direction aligned with the circumferential direction and the fiber direction angled away from the circumferential direction.

The liner of any of the previous clauses, wherein the plurality of plies of the stiffening portion include a plurality of sets of plies, each one of the plurality of sets of plies adjacent to another of the plurality of sets of plies.

The liner of any of the previous clauses, wherein each set of the plurality of sets of plies of the stiffening portion includes three plies having respective fiber directions in a sequence of: a fiber direction aligned with the circumferential direction, a fiber direction aligned with the circumferential direction, and a fiber direction angled away from the circumferential direction.

The liner of any of the previous clauses, wherein the set of plies includes a fourth ply disposed beneath the first ply, the fourth ply having a fiber direction aligned with the circumferential direction.

The liner of any of the previous clauses, further including a covering portion disposed on the stiffening portion.

The liner of any of the previous clauses, wherein the stiffening portion extends in the axial direction from a forward end to an aft end.

The liner of any of the previous clauses, wherein the forward end of the stiffening portion is disposed at an axial position in the liner from 50% to 90% of a length of the liner in the axial direction.

The liner of any of the previous clauses, wherein the liner smoothly transitions from a first thickness at the forward end of the stiffening portion to a second thickness along the stiffening portion, and wherein the liner smoothly transitions from the second thickness to the first thickness at the aft end of the stiffening portion.

The liner of any of the previous clauses, wherein the fiber direction of the second ply of the pair of plies is perpendicular to the circumferential direction.

The liner of any of the previous clauses, wherein the fiber direction of the third ply of the set of plies is perpendicular to the circumferential direction.

A method for forming a liner for a combustion section of a gas turbine engine, the liner defining a circumferential direction, the method including laying up a plurality of plies of a composite material to form a base portion of the liner, wherein the plurality of plies include a pair of plies including a first ply having a fiber direction aligned with the circumferential direction and a second ply adjacent to the first ply, the second ply having a fiber direction angled away from the circumferential direction and laying up a plurality of sets of plies of the composite material on the base portion to form a stiffening portion of the liner, each set of the plurality of sets of plies including a first ply, a second ply adjacent to and exterior to the first ply, and a third ply adjacent to and exterior to the second ply, wherein, within each set, the first ply has a fiber direction aligned with the circumferential direction, the second ply has a fiber direction aligned with the circumferential direction, and the third ply has a fiber direction angled away from the circumferential direction.

The method of any of the previous clauses, further including laying up a second plurality of plies on the stiffening portion to form a covering portion such that the respective fiber directions of adjacent ones of the second plurality of plies alternate between a fiber direction aligned with the circumferential direction and a fiber direction angled away from the circumferential direction.

The method of any of the previous clauses, wherein the fiber direction of the third ply of each set of the plurality of sets of plies is perpendicular to the circumferential direction.

The method of any of the previous clauses, wherein at least one of the plurality of sets of plies includes a fourth ply laid up between the second ply and the third ply, the fourth ply having a fiber direction aligned with the circumferential direction.

A gas turbine engine including a compressor section, a combustion section downstream of the compressor section, and a turbine downstream of the combustion section, wherein the combustion section includes a liner defining a circumferential direction and an axial direction, the liner including a base portion including a first plurality of plies of a composite material, the first plurality of plies arranged adjacent to one another and defining a first pattern of fiber directions and a stiffening portion including a second plurality of plies of the composite material, the stiffening portion disposed on the base portion and extending 360 degrees about the axial direction, the second plurality of plies arranged adjacent to one another and defining a second pattern of fiber directions different from the first pattern of fiber directions.

The gas turbine engine of any of the previous clauses, wherein the first pattern of fiber directions is a set of fiber directions in a sequence of: a fiber direction aligned with the circumferential direction, and a fiber direction angled away from the circumferential direction.

The gas turbine engine of any of the previous clauses, wherein the second pattern of fiber directions is a set of fiber directions in a sequence of: a fiber direction aligned with the circumferential direction, a fiber direction aligned with the circumferential direction, and a fiber direction angled away from the circumferential direction.

The gas turbine engine of any of the previous clauses, wherein the first pattern of fiber directions is a 0/90 pattern, and the second pattern of fiber directions is a 0/0/90 pattern or a 0/0/0/90 pattern.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A liner for a combustion section of a gas turbine engine, the liner defining a circumferential direction and an axial direction from a forward end to an aft end, the liner comprising:

a base portion comprising a first plurality of plies of a composite material, the base portion defining an inner surface of a combustion chamber; and a stiffening portion comprising a second plurality of plies of the composite material, the stiffening portion disposed on the base portion, wherein the first plurality of plies of the base portion of the liner include a pair of plies including a first ply having a first fiber direction aligned with the circumferential direction and a second ply adjacent to the first ply of the pair of plies, the second ply of the pair of plies having a second fiber direction angled away from the circumferential direction, wherein the second plurality of plies of the stiffening portion of the liner include a set of plies including a first ply having the first fiber direction aligned with the circumferential direction, a second ply adjacent to the first ply of the set of plies, the second ply of the set of plies having the first fiber direction aligned with the circumferential direction, and a third ply adjacent to the second ply of the set of plies, the third ply of the set of plies having the second fiber direction angled away from the circumferential direction, wherein the stiffening portion extends in the axial direction from a forward end to an aft end, wherein the forward end of the stiffening portion is disposed at an axial position in the liner at or aft of 50% of a length of the liner in the axial direction from the forward end of the liner, and wherein a length of the stiffening portion is at least 10% of the length of the liner in the axial direction, wherein the aft end of the stiffening portion is disposed forward of the aft end of the liner, and wherein a thickness of the liner from the inner surface to a cold side of the liner smoothly transitions from a first thickness at the forward end of the stiffening portion to a second thickness, the second thickness extending aft in a continuous manner to and terminating at a location where the liner smoothly transitions from the second thickness to the first thickness at the aft end of the stiffening portion.

2. The liner of claim 1, wherein the first plurality of plies of the base portion include a plurality of the pair of plies, each one of the plurality of the pair of plies adjacent to another of the plurality of the pair of plies.

3. The liner of claim 1, wherein the first plurality of plies of the base portion are arranged such that the first and second fiber directions of the first plurality of plies of the base portion alternate between the first fiber direction aligned with the circumferential direction and the second fiber direction angled away from the circumferential direction.

4. The liner of claim 1, wherein the second plurality of plies of the stiffening portion include a plurality of the set of plies, each one of the plurality of the set of plies adjacent to another of the plurality of the set of plies.

5. The liner of claim 1, wherein the set of plies includes a fourth ply disposed beneath the first ply of the set of plies, the fourth ply of the set of plies having the first fiber direction aligned with the circumferential direction.

6. The liner of claim 1, further comprising a covering portion disposed on the stiffening portion.

7. The liner of claim 1, wherein the second fiber direction of the second ply of the pair of plies is perpendicular to the circumferential direction.

8. The liner of claim 1, wherein the second fiber direction of the third ply of the set of plies is perpendicular to the circumferential direction.

9. The liner of claim 1, wherein the length of the stiffening portion is less than or equal to 45% of the length of the liner in the axial direction.

10. A method for forming a liner for a combustion section of a gas turbine engine, the liner defining a circumferential direction and an axial direction from a forward end to an aft end, the method comprising:

laying up a plurality of plies of a composite material to form a base portion of the liner, the base portion defining an inner surface of a combustion chamber, wherein the plurality of plies include a pair of plies including a first ply having a first fiber direction aligned with the circumferential direction and a second ply adjacent to the first ply of the pair of plies, the second ply having a second fiber direction angled away from the circumferential direction; and laying up a plurality of sets of plies of the composite material on the base portion to form a stiffening portion of the liner, each set of the plurality of sets of plies including a first ply, a second ply adjacent to and exterior to the first ply of the plurality of sets of plies, and a third ply adjacent to and exterior to the second ply of the plurality of sets of plies, wherein, within each set, the first ply of each of the plurality of sets of plies has the first fiber direction aligned with the circumferential direction, the second ply of each of the plurality of sets of plies has the first fiber direction aligned with the circumferential direction, and the third ply of each of the plurality of sets of plies has the second fiber direction angled away from the circumferential direction, wherein the stiffening portion extends in the axial direction from a forward end to an aft end, wherein the forward end of the stiffening portion is disposed at an axial position in the liner at or aft of 50% of a length of the liner in the axial direction from the forward end of the liner, and wherein a length of the stiffening portion is at least 10% of the length of the liner in the axial direction, wherein the aft end of the stiffening portion is disposed forward of the aft end of the liner, wherein a thickness of the liner from the inner surface to a cold side of the liner smoothly transitions from a first thickness at the forward end of the stiffening portion to a second thickness, the second thickness extending aft in a continuous manner to and terminating at a location where the liner smoothly transitions from the second thickness to the first thickness at the aft end of the stiffening portion.

11. The method of claim 10, further comprising laying up a second plurality of plies on the stiffening portion to form a covering portion such that the respective fiber directions of adjacent plies of the second plurality of plies alternate between the first fiber direction aligned with the circumferential direction and the second fiber direction angled away from the circumferential direction.

12. The method of claim 10, wherein the fiber direction of the third ply of each set of the plurality of sets of plies is perpendicular to the circumferential direction.

13. The method of claim 10, wherein at least one of the plurality of sets of plies includes a fourth ply laid up between the second ply of the at least one of the plurality of sets of plies and the third ply of the at least one of the plurality of sets of plies, the fourth ply of the at least one of the plurality of sets of plies having the first fiber direction aligned with the circumferential direction.

14. The method of claim 10, wherein the length of the stiffening portion is less than or equal to 45% of the length of the liner in the axial direction.

15. A gas turbine engine comprising:

a compressor section;

a combustion section downstream of the compressor section; and a turbine downstream of the combustion section, wherein the combustion section includes a liner defining a circumferential direction and an axial direction from a forward end of the liner to an aft end of the liner, the liner comprising:

a base portion comprising a first plurality of plies of a composite material, the base portion defining an inner surface of a combustion chamber, the first plurality of plies arranged adjacent to one another and defining a first pattern of fiber directions; and a stiffening portion comprising a second plurality of plies of the composite material, the stiffening portion disposed on the base portion and extending 360 degrees about the axial direction, the second plurality of plies arranged adjacent to one another and defining a second pattern of fiber directions different from the first pattern of fiber directions, wherein the stiffening portion extends in the axial direction from a forward end of the stiffening portion to an aft end of the stiffening portion, wherein the forward end of the stiffening portion is disposed at an axial position in the liner at or aft of 50% of a length of the liner in the axial direction from the forward end of the liner, and wherein a length of the stiffening portion is at least 10% of the length of the liner in the axial direction, wherein the aft end of the stiffening portion is disposed forward of the aft end of the liner, wherein a thickness of the liner from the inner surface to a cold side of the liner smoothly transitions from a first thickness at the forward end of the stiffening portion to a second thickness, the second thickness extending aft in a continuous manner to and terminating at a location where the liner smoothly transitions from the second thickness to the first thickness at the aft end of the stiffening portion.

16. The gas turbine engine of claim 15, wherein the first pattern of fiber directions is a set of fiber directions in a sequence of:

a first fiber direction aligned with the circumferential direction, and a second fiber direction angled away from the circumferential direction.

17. The gas turbine engine of claim 15, wherein the second pattern of fiber directions is a set of fiber directions in a sequence of:

a first fiber direction aligned with the circumferential direction, the first fiber direction aligned with the circumferential direction, and a second fiber direction angled away from the circumferential direction.

18. The gas turbine engine of claim 15, wherein the first pattern of fiber directions is a 0/90 pattern, and the second pattern of fiber directions is a 0/0/90 pattern or a 0/0/0/90 pattern.

19. The gas turbine engine of claim 15, wherein the length of the stiffening portion is less than or equal to 45% of the length of the liner in the axial direction.

* * * * *